US007562715B2

(12) United States Patent
Groos

(10) Patent No.: US 7,562,715 B2
(45) Date of Patent: Jul. 21, 2009

(54) FIRE PROTECTION SYSTEMS AND COMPONENTS THEREOF WITH REDUCED FRICTION

(75) Inventor: Thomas T. Groos, Ada, MI (US)

(73) Assignee: The Viking Corporation, Hastings, MI (US)

( * ) Notice: Subject to any disclaimer, the term of this patent is extended or adjusted under 35 U.S.C. 154(b) by 493 days.

(21) Appl. No.: 11/103,119

(22) Filed: Apr. 11, 2005

(65) Prior Publication Data

US 2005/0224237 A1 Oct. 13, 2005

Related U.S. Application Data

(60) Provisional application No. 60/561,488, filed on Apr. 12, 2004.

(51) Int. Cl.
*A62C 35/00* (2006.01)

(52) U.S. Cl. ..... 169/16; 169/37; 239/208; 239/500; 239/502; 239/565

(58) Field of Classification Search ..... 169/16, 169/37; 239/208, 209, 500, 502, 565, 461
See application file for complete search history.

(56) References Cited

U.S. PATENT DOCUMENTS 4,099,675 A * 7/1978 Wohler et al. ..... 239/500
4,280,562 A * 7/1981 Glinecke ..... 169/37
5,143,657 A * 9/1992 Curtis ..... 239/500

OTHER PUBLICATIONS

Kenneth Chang, "'Nanograss' Turns Sticky to Slippery in an Instant".
Kevin Coughlin, "Droplets of water could have big impact, physicist says," *The Grand Rapids Press*, Mar. 14, 2004, p. A9.

* cited by examiner

*Primary Examiner*—Steven J Ganey
(74) *Attorney, Agent, or Firm*—Harness, Dickey & Pierce, P.L.C.

(57) ABSTRACT

A fire protection system includes a conduit, with a fluid passageway for receiving fire suppressant fluid from a fire suppressant fluid supply, a discharge device in fluid communication with the conduit for dispersing the fire suppressant fluid and at least one surface at the conduit or the discharge device across which the fire suppressant fluid flows, which surface has a plurality of channels extending across the surface in a direction generally orthogonal to the flow of fluid.

19 Claims, 5 Drawing Sheets

FIG 2
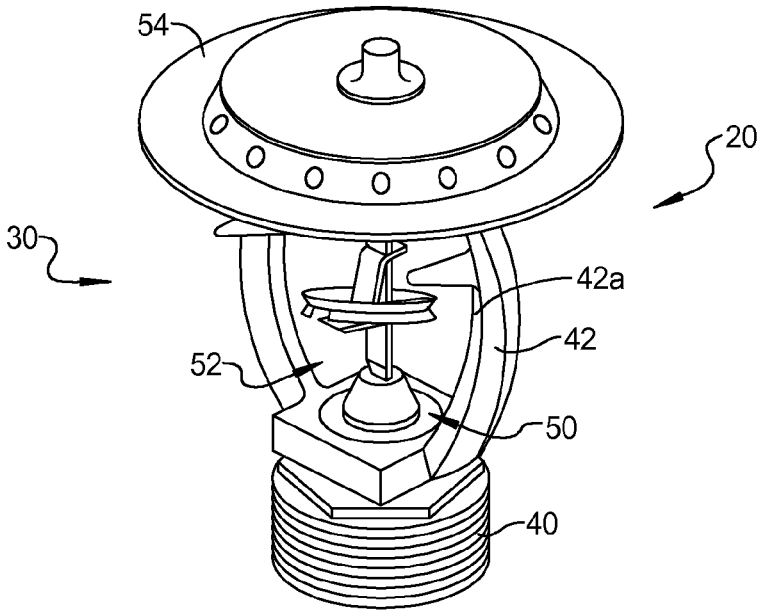
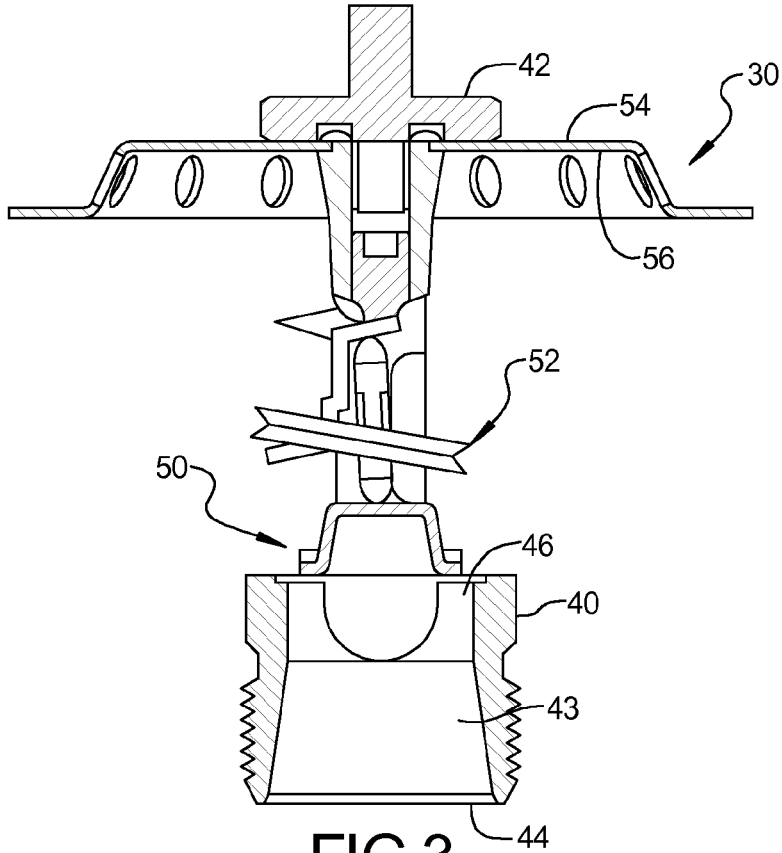
FIG 3

FIG 4
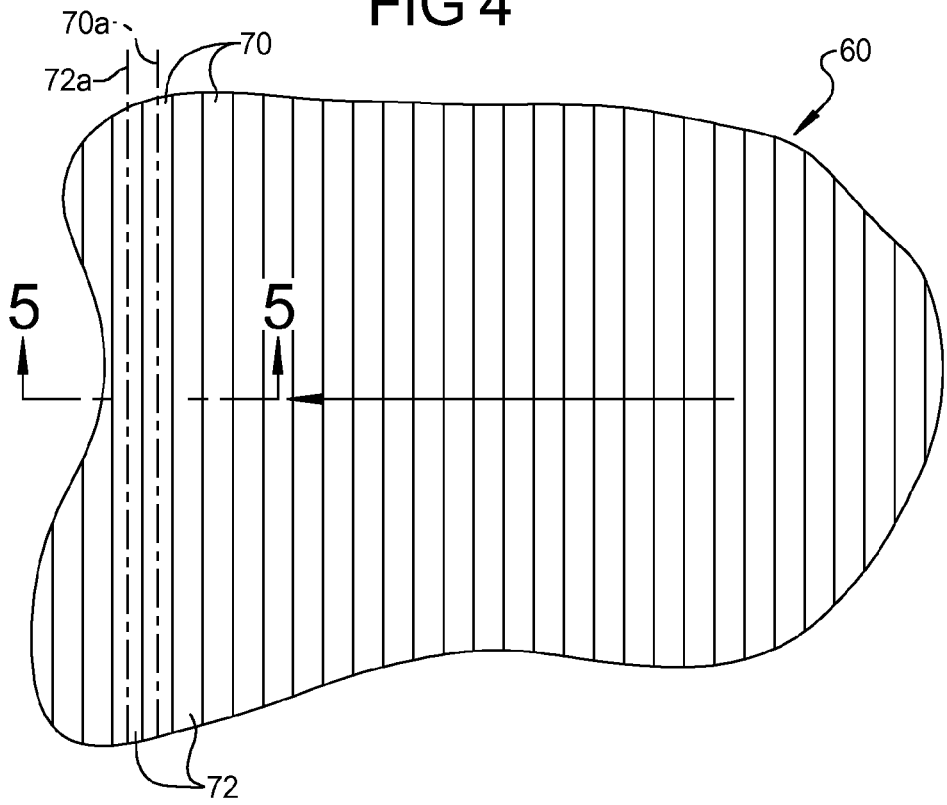
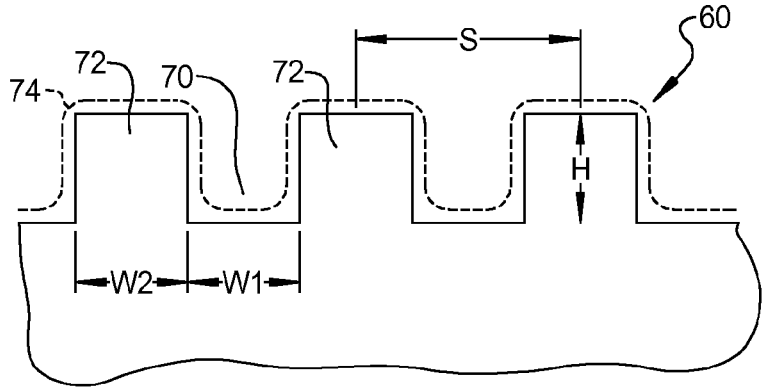
FIG 5

FIG 6
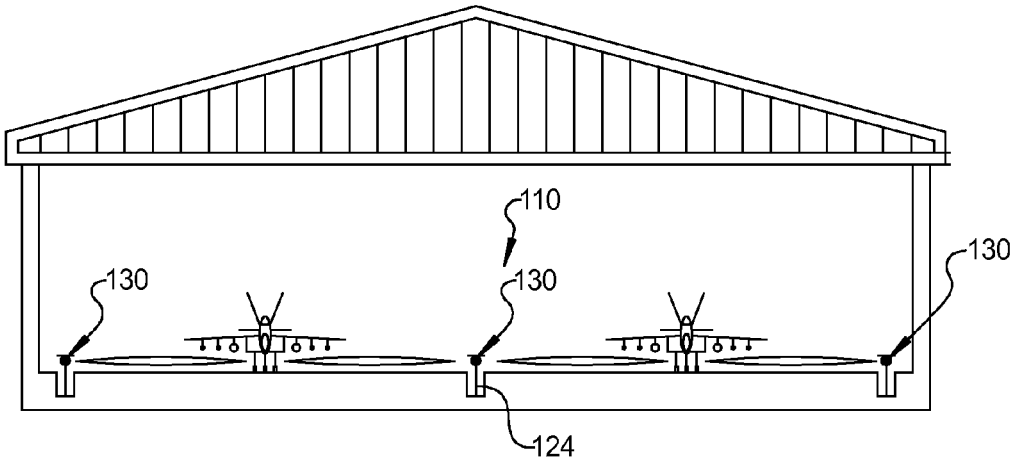
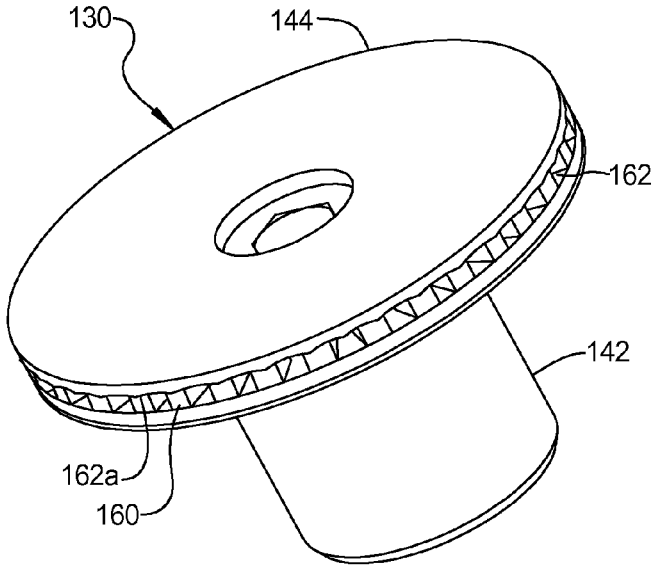
FIG 7

FIRE PROTECTION SYSTEMS AND COMPONENTS THEREOF WITH REDUCED FRICTION

This application claims the benefit of provisional application Ser. No. 60/561,488, filed Apr. 12, 2004, entitled FIRE PROTECTION SYSTEMS AND COMPONENTS THEREOF WITH REDUCED FRICTION, which is herein incorporated by reference in its entirety.

TECHNICAL FIELD AND BACKGROUND OF THE INVENTION

The present invention relates to fire protection systems and components therefor.

SUMMARY OF THE INVENTION

The present invention provides fire protection systems that exhibit reduced friction loss and, hence, pressure loss across or through one or more components of the systems. With reduced pressure loss, the pressure at the discharge locations of the systems may be increased or the supply pressure may be decreased, or a combination of both.

Accordingly, in one form of the invention a fire protection system includes a conduit, a discharge device in communication with the conduit for dispersing fire suppressant fluid that is delivered to the discharge device from the conduit, and at least one surface provided at the conduit or the discharge device across which the fire suppressant fluid flows, which surface has a plurality of channels extending across the surface in a direction generally orthogonal to the flow of fluid across that surface.

In one aspect, the surface is provided in at least one chosen from the fluid passageway of the conduit, the fluid passageway of the discharge device, the inlet of the discharge device, and the discharge orifice.

In another aspect, the discharge device comprises a sprinkler assembly. For example, the sprinkler assembly includes a base, a frame extending from the base, and a deflector mounted to the frame. The surface may be provided at the fluid passageway of the base, the inlet of the sprinkler assembly, the discharge orifice of the sprinkler assembly, the deflector, and/or the frame. In one preferred form, the surface is provided at the discharge orifice of the sprinkler assembly. In another preferred form the surface is provided in the fluid passageway of the conduit.

In other aspects, the conduit comprises system piping and at least one fitting. The surface may be provided at the fitting.

In yet another aspect, the discharge device comprises a nozzle, such as a floor nozzle.

In another form of the invention, a fire protection system includes a control valve, a conduit in fluid communication with the valve, which controls the flow of fire suppressant fluid to the conduit, a discharge device in communication with said conduit for dispersing the fire suppressant fluid, and at least one surface provided at the conduit, the valve, or the discharge device across which the fire suppressant fluid flows, which surface has a plurality of channels extending there across in a direction generally orthogonal to the flow of fluid.

In any of the inventions noted above, the channels may have a depth in a range of 0.2 microns to 10 microns, a depth in a range of 0.5 microns to 5 microns, or a depth in a range of 0.8 microns to 1.2 microns.

In any of the inventions, the channels may have a width in a range of 0.01 microns to 0.25 microns, a width in a range of 0.025 microns to 0.1 microns, or a width in a range of 0.03 microns to 0.08 microns.

In addition, in any of the inventions above, the channels form ridges there between, which have a width in a range of 0.01 microns to 0.25 microns, a width in a range of 0.025 microns to 0.1 microns, or a width in a range of 0.03 microns to 0.08 microns.

In other aspects, the surface further includes a polymeric layer over the ridges and the channels.

In preferred form, the ridges and channels are substantially uniformly spaced and, further, are substantially parallel.

Accordingly, the present system provides one or more components that exhibit reduced friction between the fire suppressant fluid and the surface across which it flows to enhance the efficiency of the system.

These and other features and advantages of the present invention will be further understood and appreciated by those skilled in the art by reference to the following specification, claims, and drawings.

DETAILED DESCRIPTION OF THE DRAWINGS

FIG. 2 is a perspective view of a sprinkler assembly of the fire protection system of FIG. 1;

FIG. 3 is a cross-section view of a sprinkler assembly of FIG. 2 taken along line III-III;

FIG. 4 is an enlarged plan view of a surface on one of the components of the fire protection system illustrated in FIGS. 1-4;

FIG. 5 is an enlarged cross-section view taken along line V-V of FIG. 4 illustrating the surface the surface topology of the surface of FIG. 4;

FIG. 6 is a schematic view of another embodiment of a fire protection system of the present invention;

FIG. 7 is a perspective view of a nozzle of the fire protection system of FIG. 6.

DETAILED DESCRIPTION OF PREFERRED EMBODIMENTS

Figure 1:
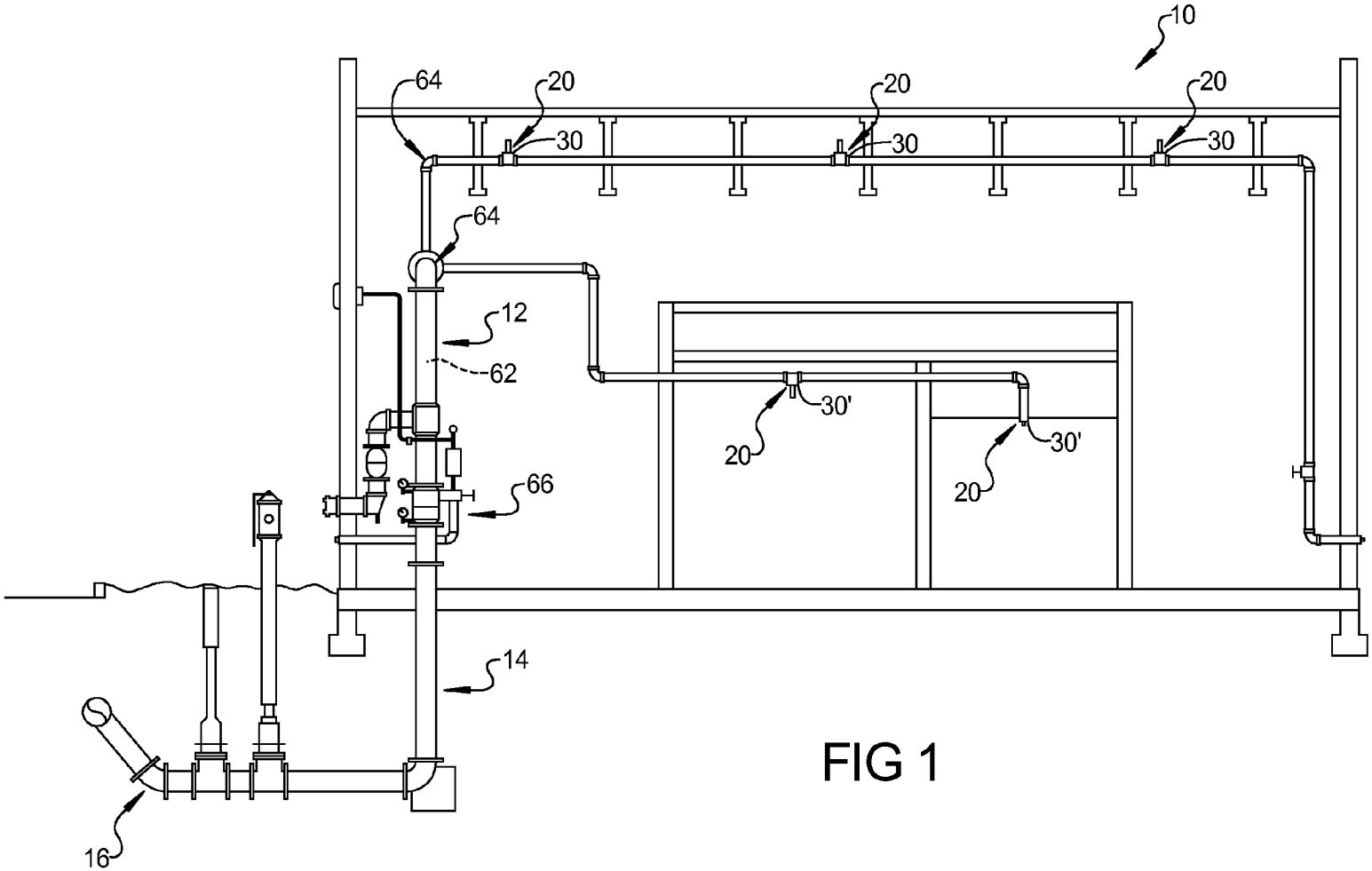
FIG. 1 is a schematic view of a fire protection system of the present invention.

Referring to FIG. 1, the numeral 10 generally designates a fire protection system of the present invention. As will be more fully described below, one or more of the components of fire protection system 10 are adapted to reduce the friction generated by the fire suppressant fluid flowing through or across the component. In this manner, the head loss through or across the particular component is reduced, thus, potentially reducing the required supply pressure or increasing the pressure of the fluid as it is dispersed from the fire suppressant system or a combination of both. As would be understood by those skilled in the art, where the supply pressure to the discharge devices of a fire protection system can be reduced, the size of the piping delivering the fire suppressant fluid to the discharge devices can be reduced and/or the size of the pump can be downsized. In some cases, the pump may be eliminated. Thus, the present invention potentially provides for significant savings in the cost of a fire protection system.

In the illustrated embodiment, fire protection system 10 comprises a wet pipe fire protection system. However, it should be understood that the present invention can be employed in a number of different types of fire protection systems, including dry pipe systems or floor spray systems, as will be more fully described below. An example of another wet pipe system that may incorporate the present invention includes the wet pipe system disclosed in U.S. Pat. No. 5,992, 532, commonly assigned to The Viking Corporation of Hastings, Michigan, which is incorporated by reference herein in its entirety. The description of wet pipe system 10 is provided as an exemplary system only and is not intended to limit the scope of the invention.

Referring again to FIG. 1, system 10 includes system piping 12 that connects to the city main supply line through a riser 14 and an underground fire main line 16 and delivers fire suppressant fluid to the various discharge devices 20. System piping 12 may be metal or may be formed from a plastic material, such as PBMS, which may facilitate the forming of the friction reducing surface, which is more fully described below, that reduces the friction through system 10.

System piping 12 includes one or more fire suppressant fluid discharge devices 20, such as sprinkler assemblies, which discharge the fire suppressant fluid when a temperature associated with a fire is detected by the trigger mechanism of the sprinkler assembly, which is more fully described below. In the illustrated embodiment, fire protection system 10 includes discharge devices 20 comprising both upright sprinkler assemblies 30 and pendent sprinkler assemblies 30'. It should be understood that the arrangement of system piping 12 and its discharge device may be varied depending on the specific application and environment in which system 10 is operating.

For ease of description, reference hereinafter will be made to upright sprinkler assembly 30, though it should be understood that pendent sprinkler assemblies 30' may also incorporate the friction reducing surface of the present invention. Referring to FIG. 2, upright sprinkler assembly 30, which includes a base 40 and a frame 42 extending from the base. Extending transversely through the base is a fluid passageway 43(FIG. 3) that extends from inlet opening 44 to discharge orifice 46. Base 40 includes a threaded portion for coupling to a branch pipe 48 of system piping 12 so that passageway 43 is in fluid communication with the fluid passageway of system piping 12. Discharge orifice 46 is closed by a sealing assembly 50, which is held in place by a trigger assembly 52, which is supported between sealing member 50 and frame 42. Trigger assembly 52 may comprise a plurality of different types of trigger assemblies, including a trigger assembly formed from fusible plates (such as shown), fusible links, or a glass bulb. For examples of suitable trigger assemblies and other sprinkler assemblies that may incorporate the present invention, reference is made herein to U.S. Pat. Nos. 6,585,054; 5,628,367; 6,082,465; 6,152,236; 6,520,265; 6,715,561; and copending U.S. provisional application Ser. No. 10/505,814, filed Sep. 25, 2003 entitled SPRINKLER HEAD WITH IMPROVED FLOW; and Ser. No. 60/500,434, filed Sep. 5, 2003 , all commonly assigned to The Viking Corp., which are herein incorporated by reference in their entireties.

To facilitate the dispersion of the fluid from the sprinkler assembly, sprinkler assembly 30 includes a deflector 54, which is similarly mounted to frame 42 and, further, supported by frame 42 at a distance spaced from discharge orifice 46. As it would be understood by those skilled in the art, when trigger assembly 52 detects a temperature associated with a fire, trigger assembly 52 releases the pressure on sealing assembly 50 to thereby open discharge orifice 46 to allow the flow of fire suppressant fluid from the base and thereafter to be disperse by deflector 54.

Referring to FIGS. 4 and 5, the numeral 60 generally designates a surface on any one of the components within system 10 across which the fire suppressant fluid may flow. Surface 60 is adapted to reduce the friction of the fire suppressant fluid as it flows across the surface in the direction as indicated by the arrow in FIG. 4. As will be more fully described below, surface 60 is adapted to make the surface slippery rather than smooth. As fluid flows across surface 60, the surface topology of surface 60 is such that it disrupts the creation of fluid droplets from being formed and also uses the surface tension of the fluid to keep the fluid moving, which dramatically increases the fluidity of the fluid. The net result is a significant reduction in friction between the fluid and surface 60.

For example, surface 60 may be provided in fluid passageway 43 of sprinkler assembly 30, including at inlet opening 44 and/or discharge orifice 46, at surface 42*a* of frame 42, or at any of the discharge orifice facing surfaces 56 of deflector 54. Surface 60 may alternately or in addition provided in fluid passageway 62 of system piping 12, in any of the fittings 64 of the system piping 12, or in the fluid passageway of supply piping 14. Surface 60 may also be provided in the chamber or in any of the fluid passageways, including inlets or outlets, of wet pipe alarm valve 66, for example. This listing is not intended to be exhaustive of the possible locations of surface 60 but, instead, is merely exemplary of the possible locations for the surface.

As noted above, system 10 is adapted to reduce the friction between a surface of one or more of the components of system 10 and the fluid flowing across the surface to thereby reduce the head loss in the system. As would be appreciated by those skilled in the art, a reduction of the head loss in the system, results in increased pressure at the output of the system, namely for example at discharge devices 20, or reduces the input pressure required from the city main line. In some instances, this could downsize the pump (not shown) requirements or eliminate the need for a pump.

Referring again to FIGS. 4 and 5, surface 60 includes a plurality of channels 70 and ridges 72, which extend across surface 60 preferably in a parallel evenly spaced arrangement and, further, such that their respective longitudinal axes 70*a* and 72*a* are generally perpendicular to the flow of fluid across surface 60, which is indicated by the arrow in FIG. 4. Channels 70 have a depth, H, in a range of 0.2 microns to 10 microns, more preferably, in a range of 0.5 microns to 5 microns, and most preferably in a range of 0.8 microns to 1.2 microns. Their width, W1, is preferably in a range of 0.01 microns to 0.25 microns, more preferably in a range of 0.025 microns to 0.1 microns, and most preferably in a range of 0.03 microns to 0.08 microns. Ridges 70 preferably have a width W2 that is substantially equal to W1 of channels 70. In addition, as noted above, ridges 72 and channels 70 are substantially uniformly spaced and, further, are substantially parallel. Further the spacing S between ridges, as measured from the center of each ridge, is preferably in a range of 0.02 microns to 0.5 microns, more preferably in a range of 0.05 microns to 0.2 microns, and most preferably in a range of 0.06 microns to 0.16 microns.

In some applications, surface 60 may includes a polymeric layer 74 over the ridges 72 and the channels 70 to facilitate the forming process. For example, where the dimensions of the channels and ridges may not be achieved using a laser cutting apparatus, including a rotating laser, for example, the polymeric layer may be used to partially fill layer channels to achieve the desired dimensions. Currently, laser cutting contemplated to be the most efficient method of achieving the desired surface topology of surface 60.

Figure 8:
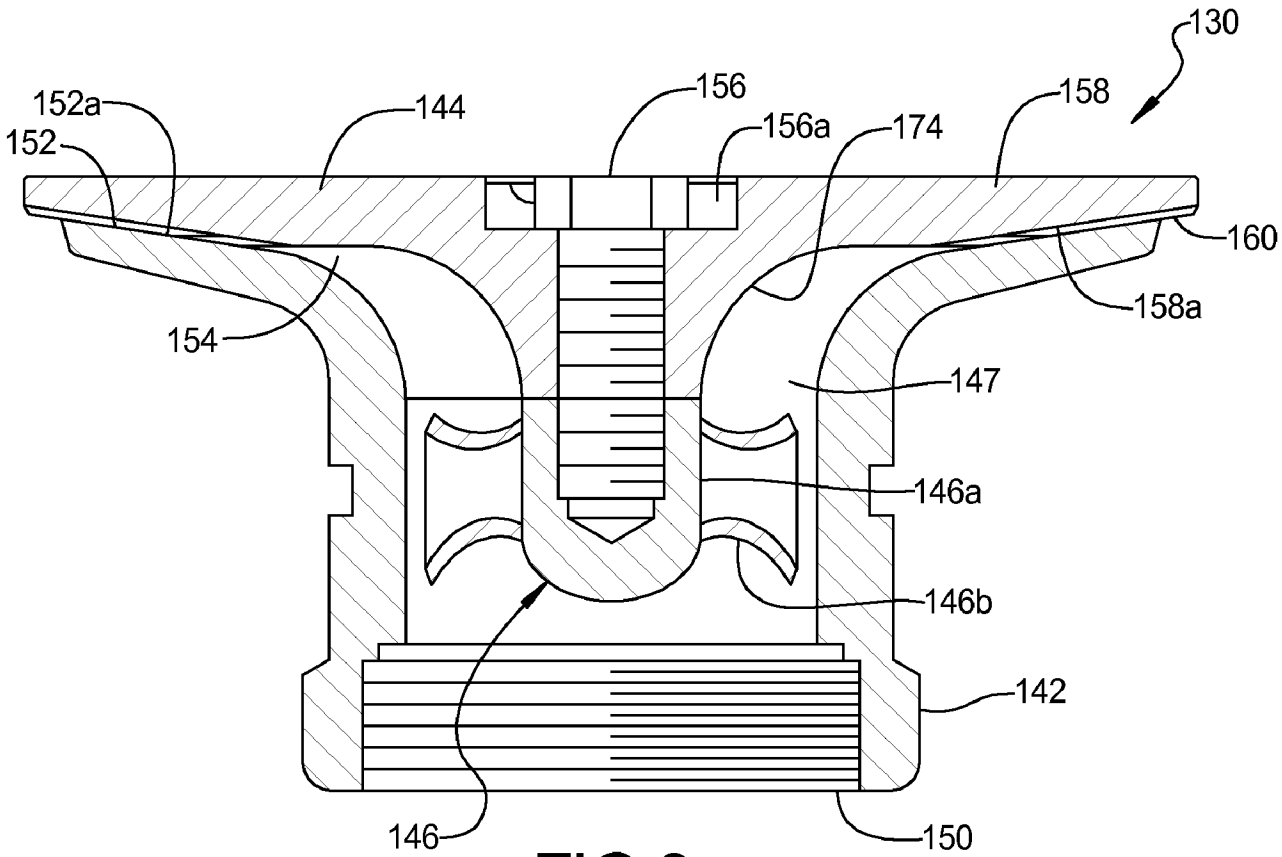
FIG. 8 is a cross-sectional view taken along line VIII-VIII of FIG. 7.

Referring to FIG. 6-8, as noted above the present invention may be incorporated in other fire protection systems, such as a floor fire protection system 110. System 110 is particularly suitable for extinguishing fires in a floor area of a hanger, or other aircraft areas including, for example, a helicopter deck, a runway, or the like. Fire protection system 110 is designed for positioning in a trench of the floor area and includes a supply pipe 124 that delivers fire suppressant fluid to a plurality of discharge devices in the form of nozzles 130.

Nozzles 130 are designed to apply water or water foam solution such as aqueous film forming foam (AFFF) to the floor area and are supported in grating provided in the floor area. Each nozzle 130 includes a base or body 142 and a deflector 144, which is supported on a central web or support 146 of base 142. When recessed in the grating, deflector 144 lies generally flush with the floor's surface.

Base 142 includes a transverse passage 147, which defines an inlet opening 150 and an outlet opening 154. Body 142 further includes a body flange 152 which extends around outlet opening 154, which supports the nozzle in the grating and, further, defector 144. Deflector 144 includes a deflector flange 158 that is spaced from outlet opening 154 and is substantially solid except for its central mounting opening through which a fastener extends to secure deflector 144 to support 146. Deflector 144 is, therefore, substantially impervious and provides a solid deflecting surface for the fire suppressant. To further deflect and, moreover, direct the fire suppressant, deflector 144 includes a plurality of projecting members 160 that extend from deflector flange 158 to body flange 152 and which preferably rest on upper surface 152*a* of flange 152 to thereby define a plurality of radial passageways 162 through which the fire suppressant flows to form the generally lateral radial pattern.

Deflector 144 is mounted to central support 146 by mounting web 174 and a threaded fastener 156, which extends through central mounting opening 156*a* and web 174 and is preferably counter sunk in central opening 156*a* of deflector 144. In the illustrated embodiment, central web 146 comprises a cylindrical body 146*a*, which is preferably centrally located in body 142 and in passage 147 and is supported in passage 147 by radial arms 146*b*. For further details of system 110 and nozzle 130, reference is made to U.S. Pat. No. 6,182,767, which is commonly owned by The Viking Corp., and which is incorporated herein by reference in its entirety.

As would be understood, surface 60 may also be provided in any of the fluid passageways of system 110 and on the various surfaces of nozzles 130 across which the fire suppressant fluid flows. For example, surface 60 may be provided at inlet 150, in passageway 147, at outlet 154, on deflector 144, including on projecting members 160, as well as central support 146, for example on arms 146*b* or body 146*a*. Again, these surfaces or locations are listed as exemplary only and are not intended to be exhaustive of the possible locations where surface 60 may be provided.

While several forms of the invention have been shown and described, other forms will now be apparent to those skilled in the art. Therefore, it will be understood that the embodiments shown in the drawings and described above are merely for illustrative purposes, and are not intended to limit the scope of the invention, which is defined by the claims, which follow as interpreted under the principles of patent law including the doctrine of equivalents.

The embodiments of the invention in which an exclusive property or privilege is claimed are defined as follows:

1. A fire protection system comprising:

a conduit having a fluid passageway, said conduit for receiving fire suppressant fluid from a fire suppressant fluid supply;

a discharge device in fluid communication with said conduit for dispersing the fire suppressant fluid, said discharge device having an inlet, a discharge orifice, and a fluid passageway there between; and at least one surface at said conduit or said discharge device across which the fire suppressant fluid flows, said surface having a plurality of channels, each of said channels defining a longitudinal axis, said channels extending parallel to said surface such that said longitudinal axis is generally orthogonal to the flow of fluid, wherein said channels have a depth in a range of 0.2 microns to 10 microns, said channels have a width in a range of 0.01 microns to 0.25 microns and said channels form ridges therebetween, said ridges having a width in a range of 0.01 microns to 0.25 microns.

2. The fire protection system according to claim 1, wherein said surface is provided on at least one chosen from said fluid passageway of said conduit, said fluid passageway of said discharge device, said inlet of said discharge device, and said discharge orifice.

3. The fire protection system according to claim 1, wherein said discharge device comprises a sprinkler assembly.

4. The fire protection system according to claim 3, wherein said sprinkler assembly includes a base, a frame extending from said base, and a deflector mounted to said frame, said surface being provided on at least one of said fluid passageway of said sprinkler assembly, said inlet of said sprinkler assembly, said discharge orifice of said sprinkler assembly, said deflector, and said frame.

5. The fire protection system according to claim 4, wherein said surface is provided on at least said discharge orifice of said sprinkler assembly.

6. The fire protection system according to claim 1, wherein said surface is provided at said fluid passageway of said conduit.

7. The fire protection system according to claim 1, wherein said conduit comprises system piping and at least one fitting.

8. The fire protection system according to claim 7, wherein said surface is provided at said fitting.

9. The fire protection system according to claim 1, wherein said conduit comprises system piping and at least one valve.

10. The fire protection system according to claim 1, wherein said discharge device comprises a nozzle.

11. A fire protection system comprising:

a control valve;

a conduit having a fluid passageway in fluid communication with said valve, said valve controlling the flow of fire suppressant fluid to said conduit, said conduit for delivering fire suppressant fluid to a discharge device;

a discharge device for dispersing the fire suppressant fluid, said discharge device having an inlet, a discharge orifice, and a fluid passageway there between; and at least one surface at said conduit, said valve, or said discharge device across which the fire suppressant fluid flows, said surface having a plurality of channels extending across said surface in a direction generally orthogonal to the flow of fluid, wherein said channels have a depth in a range of 0.2 microns to 10 microns, said channels have a width in a range of 0.01 microns to 0.25 microns and said channels form ridges therebetween, said ridges having a width in a range of 0.01 microns to 0.25 microns.

12. The fire protection system according to claim 11, wherein said control valve includes trim piping to control the opening and closing of said valve, said trim piping having fluid passageways through which the fire suppressant fluid flows.

13. The fire protection system according to claim 12, wherein said surface is provided on at least one chosen from said fluid passageway of said conduit, said fluid passageway of said discharge device, said fluid passageways of said trim piping, said inlet of said discharge device, and said discharge orifice.

14. The fire protection system according to claim 11, wherein said discharge device comprises one chosen from a sprinkler assembly and a nozzle.

15. The fire protection system according to claim 11, wherein said surface includes said ridges between said channels, further comprising a polymeric layer over said ridges and said channels.

16. The fire protection system according to claim 11, wherein said ridges are substantially uniformly spaced.

17. The fire protection system according to claim 11, wherein said ridges are substantially parallel.

18. The fire protection system according to claim 11, wherein said channels are substantially uniformly spaced.

19. The fire protection system according to claim 11, wherein said channels are substantially parallel.

* * * * *